US007044437B1

(12) United States Patent
Martin

(10) Patent No.: US 7,044,437 B1
(45) Date of Patent: May 16, 2006

(54) FLEXIBLE SIZE SPARGER FOR AIR COOLED CONDENSORS

(75) Inventor: Robert T. Martin, Fernandina Beach, FL (US)

(73) Assignee: Fisher Controls International LLC., St. Louis, MO (US)

( * ) Notice: Subject to any disclaimer, the term of this patent is extended or adjusted under 35 U.S.C. 154(b) by 49 days.

(21) Appl. No.: 10/988,111

(22) Filed: Nov. 12, 2004

(51) Int. Cl.
*F16K 47/00* (2006.01)
*F16L 55/02* (2006.01)

(52) U.S. Cl. ..... 251/127; 138/42

(58) Field of Classification Search ..... 251/118, 251/127; 138/37, 42
See application file for complete search history.

(56) References Cited

U.S. PATENT DOCUMENTS 4,109,680 A * 8/1978 Lavender ..... 137/599.11
5,769,122 A 6/1998 Baumann et al.
5,941,281 A 8/1999 Baumann et al.
6,095,196 A 8/2000 McCarty et al.
RE36,984 E * 12/2000 Steinke ..... 137/625.33

* cited by examiner

*Primary Examiner*—Edward K. Look
*Assistant Examiner*—John K. Fristoe, Jr.
(74) *Attorney, Agent, or Firm*—Marshall, Gerstein & Borun LLP

(57) ABSTRACT

A flexible size diffuser grid assembly formed up of individual sparger units for use as a noise abatement device to reduce the fluid pressure in a predetermined manner to substantially reduce the aerodynamic noise and structural vibrations produced by a fluid moving therethrough. The sparger grid assembly is formed in a window pane grid-like arrangement of individual sparger pane units, each of which are mounted in a support frame, and each of which utilize individual stack of flat plates, the plates respectively having inlet slots and outlet slots, and interconnecting plenums, to create a series of passageways to substantially subdivide the flow stream of steam into smaller portions to reduce fluid pressure. The individual sparger units can be formed of a standard size, or instead formed of custom sizes, and greater or less numbers of individual window pane sparger units can be used in the frame, depending on the given end-use application.

24 Claims, 7 Drawing Sheets

FLEXIBLE SIZE SPARGER FOR AIR COOLED CONDENSORS

TECHNICAL FIELD

The noise abatement device and method described herein makes known an apparatus and method for creating a flexible size diffuser and/or sparger to substantially reduce lower frequency noises and related vibrations, such as for use in industrial process plants such as use within a duct for an air cooled condenser used in power generating plants. More specifically, a built-up sparger framework formed of window-pane like individual fluid pressure reduction devices is disclosed as formed in a specific arrangement held within a frame that minimizes the restriction to fluid flow in a duct past the sparger apparatus.

BACKGROUND

Numerous process applications in industrial process plants require controlled or engineered pressure reductions to operate efficiently. One such facility wherein controlled pressure reductions are elemental for general operation and as well as for operating at peak efficiency are power generating stations. Modern power generating stations or power plants use steam turbines to generate power. In the so-called turbine bypass mode of such a generating plant, steam that is routed away from the turbine through a bypass loop and must be recovered or returned to water, such as occurs during turbine maintenance periods or shutdowns, where continued boiler operation is more economical than complete boiler shutdown or during normal plant startups and shutdowns. In turbine bypass mode, supplemental piping and valves that circumvent the steam turbine and redirect the steam to a recovery circuit are used to reclaim the steam for further use. Air-cooled condensers are often used to recover steam from the bypass loop and turbine-exhausted steam. An air-cooled condenser facilitates heat removal by forcing low temperature air across a heat exchanger in which the steam circulates. Air-cooled condensers, thus, condense saturated steam before it returns to the plant's feedwater pumps.

Because the bypass steam does not produce work through the turbine, its pressure and temperature is greater than the turbine-exhausted steam. In order to maintain the economy of smaller pipeline sizes, fluid pressure reduction devices, commonly referred to as spargers, are often used to allow the bypass steam to take a final pressure reduction into the condenser duct. Typical spargers are constructed of a hollow housing which receives the bypass steam and a multitude of ports along the hollow walls of the housing to provide fluid passageways to the exterior surface. Spargers operate by dividing the incoming fluid into progressively smaller, high velocity jets, whereby the sparger reduces the pressure of the oncoming bypass steam and vaporizes any residual spray water within acceptable limits prior to entering the air-cooled condenser.

Typical spargers require sufficient controlled flow area such that when installed, they extend a substantial distance into the condenser duct. However, such sparger devices have the unwanted effect of restricting steam flow past the spargers within the condenser duct. Further, the pressure of the reduced bypass steam is typically in the range of 30 to 150 psi, and during turbine shutdown, the pressure within the condenser duct is generally at partial vacuum. As the reduced bypass steam goes through typical sparger units and enters the condenser duct, the fluid pressure is lowered through the restrictive passageway of the sparger units and the potential energy in the fluid is subsequently converted to kinetic energy in the form of turbulent fluid motion. That turbulent fluid motion, in an air-cooled condenser system, can create undesired aerodynamic conditions, inducing physical vibration, and noise in significant magnitudes. To accomplish this energy reduction, the external volume of the typical sparger is necessarily increased. As known to those skilled in the art, the increased volume of the sparger can create substantial increases in condenser duct backpressure, which can be detrimental to turbine operation. There is a need for a sparger device that can substantially eliminate the lower frequency noises typically produced by interaction of sparger devices with the duct which can be harmful, i.e., damaging structural elements and unwanted vibration within the condenser duct, while also minimizing higher frequencies included through 8000 Hz as required for normal site permits without substantially increasing system backpressure.

SUMMARY OF THE INVENTION

Accordingly, one aspect of the present noise abatement device is to provide a fluid pressure reduction unit, such as a sparger apparatus, to minimize protrusion of the sparger apparatus into the condenser duct, which thereby minimizes restriction of steam flow past the sparger unit within the condenser duct, and to provide a low predictable level of resultant noise and vibration.

In accordance with another aspect of the present disclosure, the sparger device comprises a stacked flat plate noise reduction unit, as built into individual "brick"-type shapes, with such separate units then assembled into a custom or standard size "window pane" frame structure as mounted in an appropriate opening on the side wall of a condenser duct. Appropriate piping is used to supply the turbine bypass steam to those window pane sparger units. The window pane grid of sparger units can be in a flat panel format, or of curved form, to fit the shape of the needed pipe or duct surface to which it and the surrounding support frame are to be mounted.

In accordance with another aspect of the present disclosure, respective plenum plates and flow plates make up the assembled window pane sparger blocks, that are then formed into a grid pattern within a support frame to create a desired noise abatement device during Turbine Bypass for a power generating plant.

In accordance with yet another aspect of the present disclosure, an apparatus to substantially reduce aerodynamic and structural noise within an air-cooled condenser is established, through use of an assembled arrangement of individual stack plate noise reduction units, which will also provide a predictable back pressure to the plant's upstream control value.

BRIEF DESCRIPTION OF THE DRAWINGS

The features of this noise abatement device believed to be novel are set forth with particularity in the appended claims. The present noise abatement device may be best understood by reference to the following description taken in conjunction with the accompanying drawings in which like reference numerals identify like elements in the several figures, and in which:

DETAILED DESCRIPTION OF THE DRAWINGS

To fully appreciate the advantages of the present sparger and noise abatement device, it is necessary to have a basic understanding of the operating principles of the steam power generation plant and specifically, the operation of the closed water-steam circuit within the power plant. Thus, reference is made to the complete explanation of such power plant, as found in U.S. patent application Ser. No. 10/387,145 filed Mar. 12, 2003, entitled "Noise Abatement Device and Method for Air-Cooled Condensing Systems", which is incorporated herein by reference.

Accordingly, during certain operational stages of a power plant, such as start-up and turbine shutdown, the steam turbine loop is circumvented by a so-called turbine bypass loop. With various prior art versions of spargers, and including the one disclosed in the above-noted U.S. patent application Ser. No. 10/387,145, the noise abatement devices or so-called spargers are positioned to extend a substantial distance inside the condenser duct. Such spargers create the needed fluid pressure drop required by the air-cooled condenser, i.e. by splitting the flow of incoming fluid into many small jets through a plurality of passageways formed along the outer edges of a multiple number of spargers. The position and spacing of such sparger units impart aerodynamic characteristics of the air-cooled condenser steam.

Figure 1:
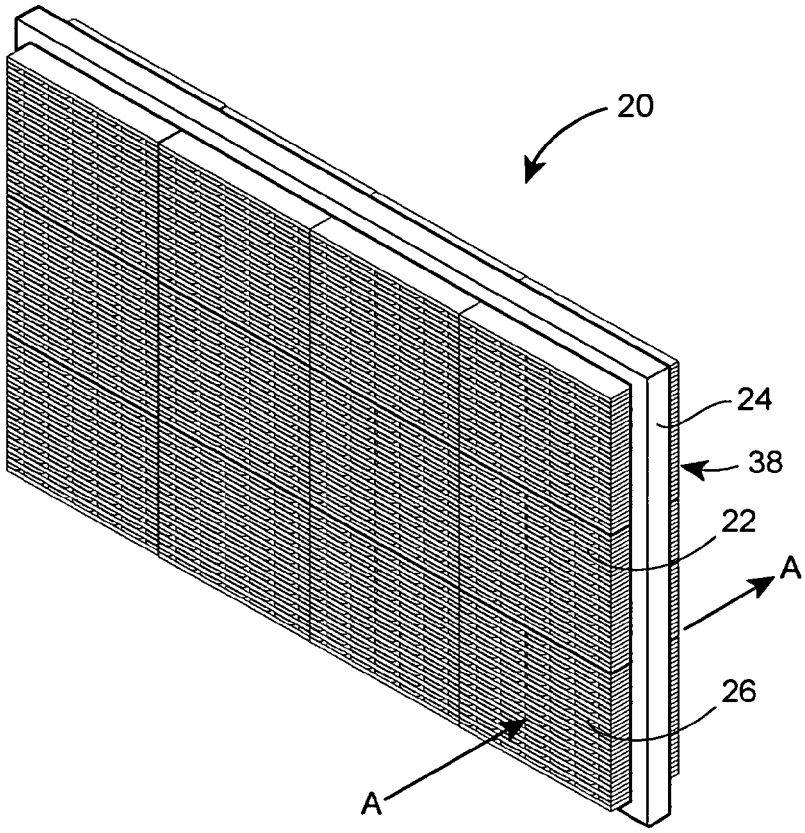
FIG. 1 is a perspective view of a rectangular configuration of an assembled flat grid pattern of individual sparger units, as held in a support frame, with each unit using flow plates and plenum plates to create the desired pressure drop.
Figure 1A:
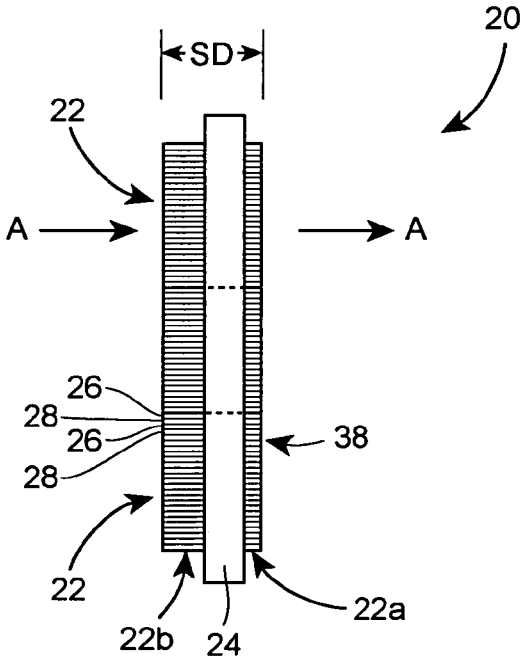
FIG. 1A is a side view of the sparger unit grid of FIG. 1.
Figure 2:
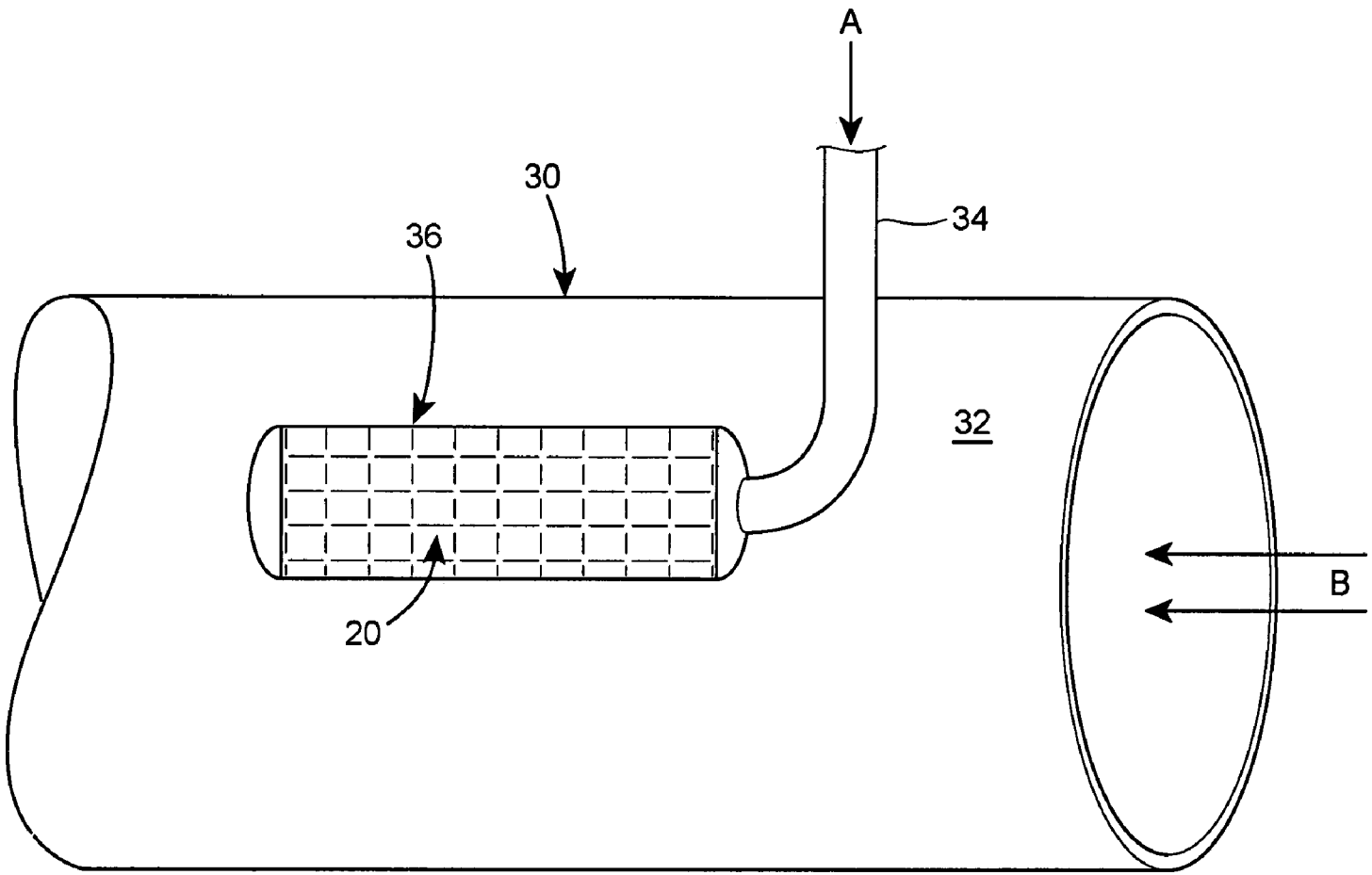
FIG. 2 depicts an application of the window pane structure of the sparger units of FIG. 1, but as used in curved pattern in a sparger-based air-cooled condenser system.

Turning to the sparger grid assembly of the present disclosure, as generally denoted by reference number 20 in FIG. 1, it is seen that the sparger assembly 20 is formed of a plurality of individual sparger pane units 22. As seen in FIGS. 1 and 1A, the individual sparger units 22 forming the sparger grid assembly 20 are collectively mounted so as to be maintained within a support frame 23. Each individual sparger unit 22 comprises a plurality of stacked flat plates 38, including flow plates 26 and plenum plates 28. As seen in FIG. 1A, only a small depth dimension, i.e. depth 22*a*, of the sparger units 22 extend to the right of the frame (in that Figure), while the greater depth portion or depth 22*b* of sparger units 22 extends to the left (in that Figure). Thus, with the present sparger units 22, their protrusion into the condenser duct 30 is substantially reduced versus the prior art spargers.

In the preferred embodiment of the noise abatement device of the present disclosure, the sparger assembly 20 is positioned such that the fluid flow (represented in the direction of arrows A—A in FIG. 1) to be at a transverse direction (if square duct work used) or radial direction (if round duct work used) relative to the steam flow through the condenser duct 30 (see FIG. 3) and sparger plenum 36. However, due to the low overall profile provided by the sparger grid assembly 20 (i.e. its small extension depth relative to the condenser duct 30), that low profile thereby limits the fluid restriction within the duct 30, and hence the back pressure, as often caused by conventional sparger units, as can be experienced within the associated steam turbine during its normal operation.

Figure 3:
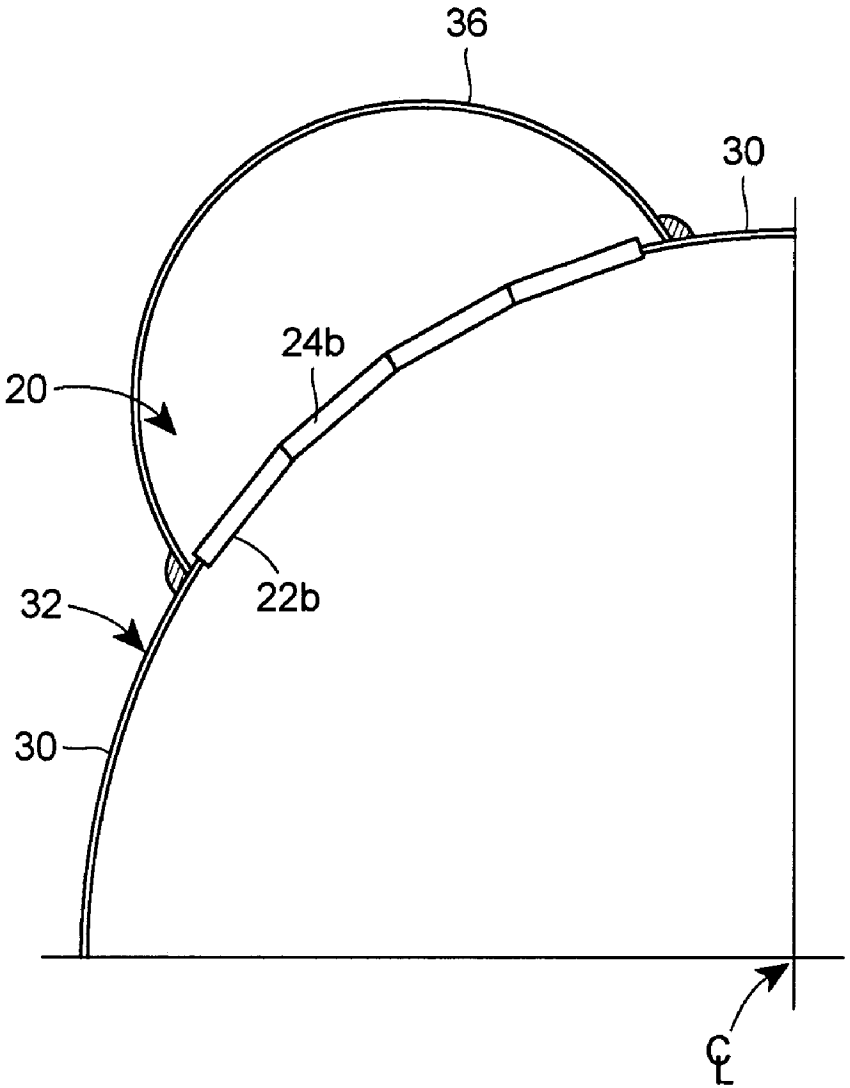
FIG. 3 is a cross section view of the window pan sparger structure and condenser system piping of FIG. 2.

Turning to FIG. 3, there is shown the sparger grid assembly 20, as formed into a curved (rather than flat) panel format, as mounted to and used in connection with a circular air-cooled condenser duct 30. The sparger grid assembly 20 is mounted via support frame 24 directly to the wall surface 32 of duct 30, within the sparger plenum 36, such that only a smaller depth 22*a* of each sparger unit 22 extends into the interior of duct 30, while a larger depth 22*b* of unit 22 extends exteriorly of duct 30 into the area covered by plenum 36. A bypass valve piping duct 34 communicates at one end with the sparger plenum 36, which covers over the curved sparger grid assembly 20 mounted to wall 32, and at its other end is connected to the main steam, hot reheat steam and/or low pressure steam piping as applicable according to the specific design (not shown) of the generating plant system.

That is, instead of extending deeply into the fluid flow of the duct 30 and typically blocking between 1 to 5 square meters of internal duct areas depending on plant design, as found with prior art type spargers, the present sparger grid assembly 20 has its respective sparger pane units 22 positioned to be mounted along the surface of the duct 30 in a stacked brick-by-brick, window pane-like arrangement, with only minimal extension and intrusion into the condenser duct 30. The individual sparger pane units 22 are held in place, as mounted to and within a sparger frame 24.

The thickness of the duct wall 32 is normally within the range of only from approximately 0.5 to 1.0 inches, relative to the overall diameter of condenser duct 30, i.e., which is usually approximately 8 to 26 feet, such as 23 feet in diameter. However, the overall depth (i.e. full external to full internal thickness or depth dimension) of an individual sparger pane unit 22 is only in the range of preferably some 4 to 8 inches (This is shown as dimension SD in FIG. 1A.). Thus, only a depth 22*a* of some 2 inches will normally extend into the duct 30.

Figure 4B:
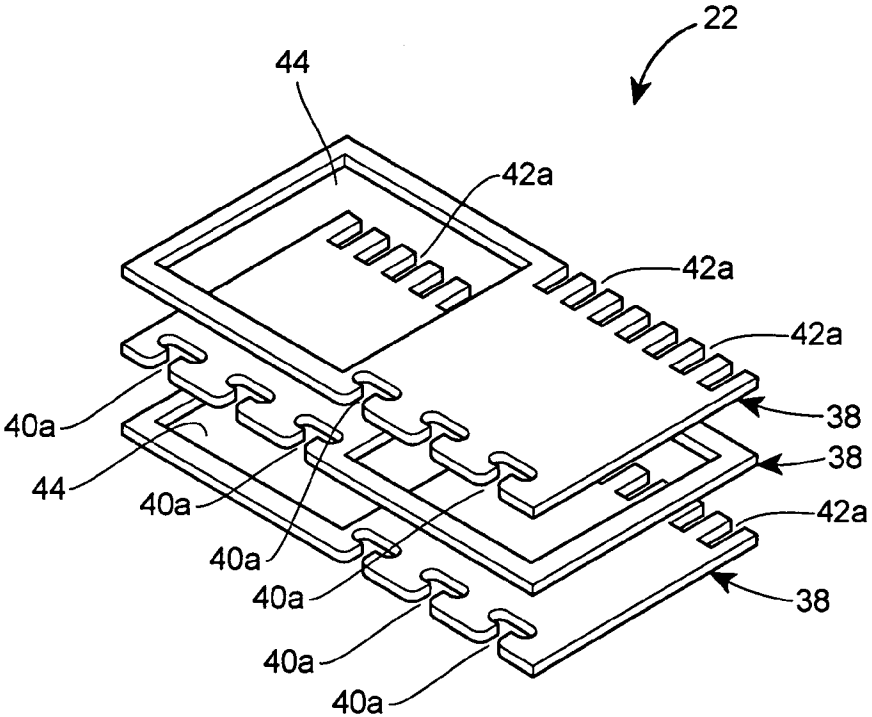
FIG. 4B is an enlarged exploded perspective view of an alternative embodiment arrangement of the individual plates for an individual sparger unit, and wherein the respective flow and plenum regions are depicted as combined within a single plate.
Figure 4A:
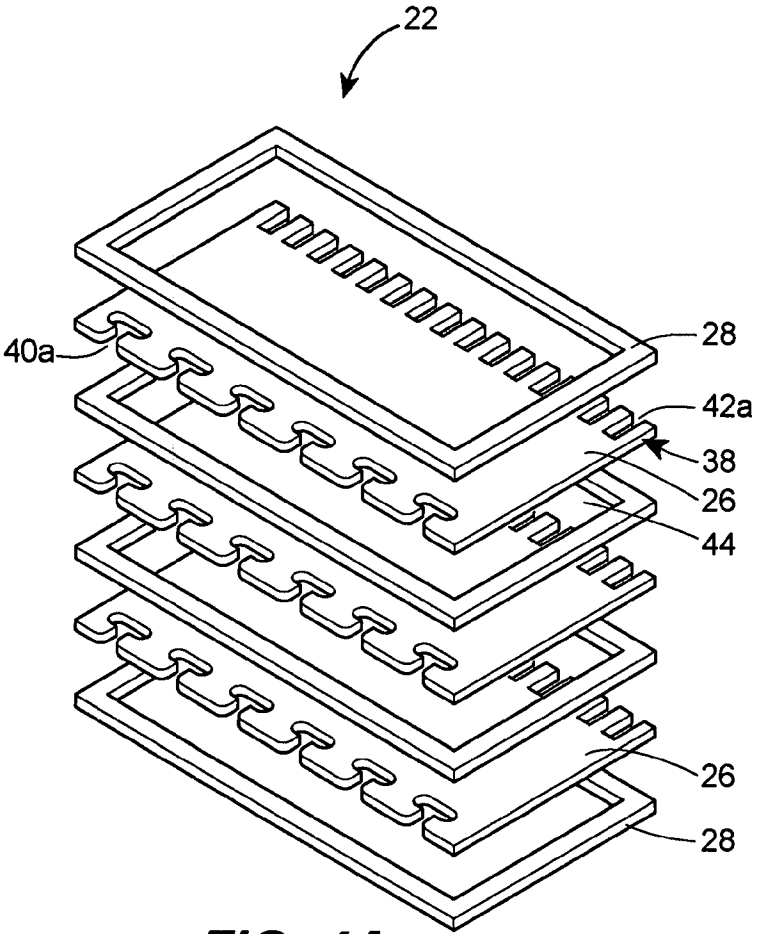
FIG. 4A is an enlarged exploded perspective view of the individual flow and plenum plates for an individual sparger unit of FIG. 1.
Figure 5:
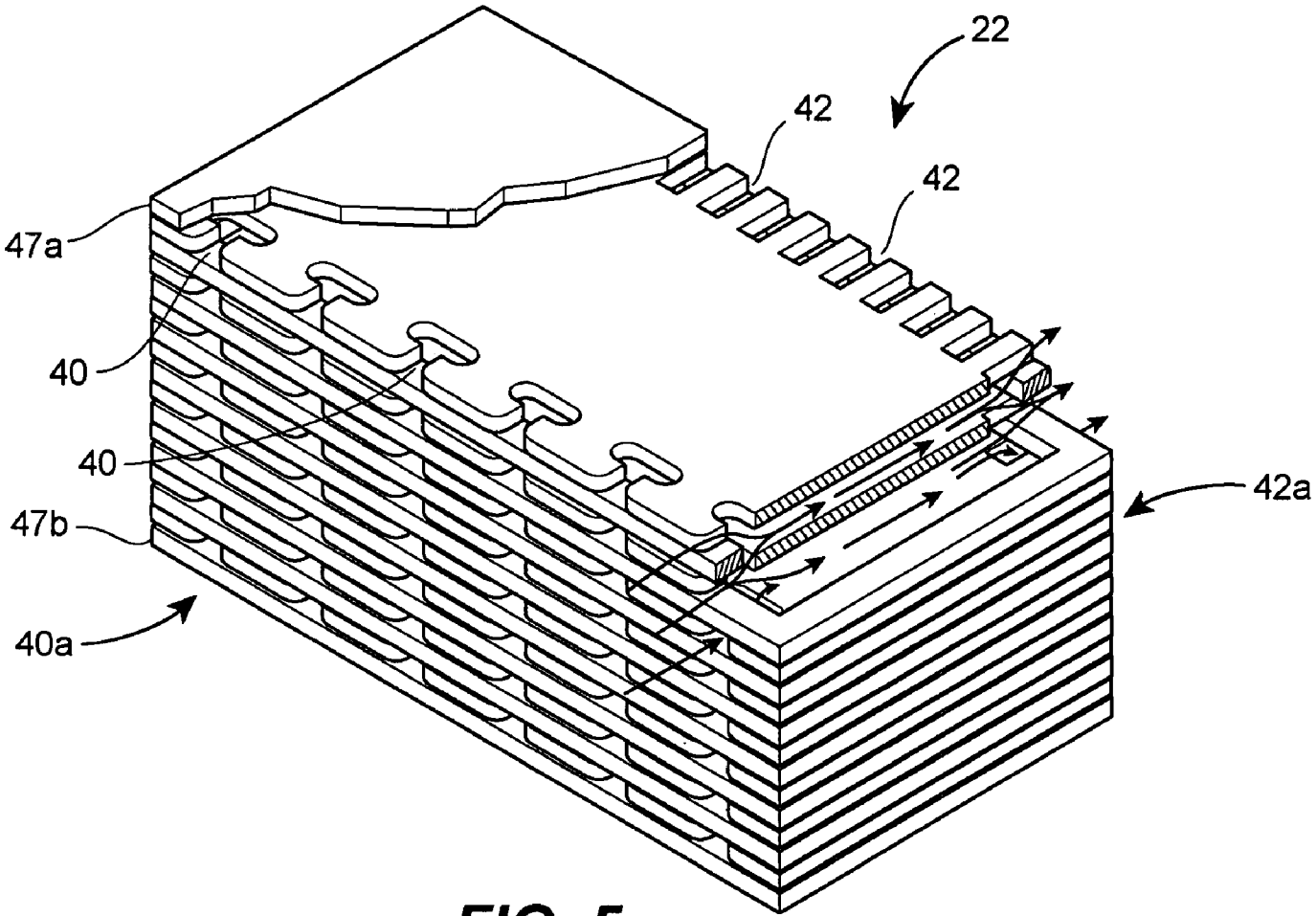
FIG. 5 is a further enlarged view of the plates of FIG. 4A as assembled.

FIGS. 4A, 4B, and 5 illustrate the sparger grid assembly 20 comprised of individual sparger pane units 22, wherein each sparger pane unit 22 comprises a plate stack formed of flat plates 38 having a first or inner end and a second or outer end. More specifically, each flow plate 26 has an inlet stage 40*a* formed on the first end and an outlet stage 42*a* formed on the second end. Further, as seen in FIG. 4A, each intervening plenum plate 28 includes interconnecting plenums 44. Thus, by selectively positioning and orienting the plates 38, i.e. the respective flow plates 26 and plenum plates 28, a series of fluid passageways 46 are created amongst the interconnecting plenums 44. More specifically yet, the first end of the flat plates 26 have the inlet stage 40*a* comprising inlet slots 40, and the second and substantially opposite end of the plates 26 have the outlet stage 42*a* comprising outlet slots 42. The inlet slots 40 extend partially from the first end to the second end, while the outlet slots 42 extend partially from the second end to the first end, with such respective extensions being sufficient to overlap into the plenums 44 of the respective plenum plates 28, thereby creating fluid passageways from the first end to the second end. In effect, the flow of fluid 48 is directed only through the fluid inlet stage slots 40 of the flow plates 26 as aligned with the plenums 44 in adjacent plenum plates 28 and to the fluid outlet stage slots 42 in the flow plates 26. In this fashion, the fluid flow path is split into two initial axial, i.e. transverse, directions, then into the plenums 44 with multiple radial, i.e. transverse, flow directions, and then is distributed through multiple outlet stage slots in the flow plates. As seen, there are more outlet slots 42 on the second end than inlet slots 40 on the first end for a given sparger unit 22. Preferably, the ratio of outlet slots is at least approximately 2:1, and more preferably, approximately 4:1 and higher or greater. However, other ratios greater than 1:1 can be contemplated without departing from the spirit and scope of the disclosed sparger. The increased inlet-to-outlet ratio assists in substantially further dividing the fluid flow of fluid 48.

In FIG. 4B is shown an alternate arrangement for the stack of flat plates 38, wherein the respective flow and plenum regions are combined within a single flat plate 38. That is, the left half (as seen in FIG. 4B) of each of the upper and lower plates 38 has the plenum region 44, while the right half of each of those plates 38 includes the flow region, with the inlet slots 40 of inlet stage 40*a*, and the outlet slots 42 of the outlet stage 42*a*. As will be noted, the middle one of the plates 38 has been reversed in its alignment. In essence, by alternating the respective plenum regions and flow regions of the respective adjacent stacked plates 38, the needed flow patterns within the stack of plates 38 can be created.

In operation, fluid 48 enters into the respective window pane sparger unit 22 at the first end via the inlet slots 40 and flows through the passageways 46 created by the interconnecting plenum 44. As seen in FIG. 5, for example, the flow path geometry created within the sparger unit 22 produces staged pressure drops by creating pressure recovery zones wherein the fluid flow is accelerated through the restrictive passageways of an inlet slot 40 and subsequently permitted to expand downstream of the restriction and mix within the interconnecting plenums 44 (shown in FIG. 4B) subsequently reducing the pressure. Additionally, the flowstream is subdivided into smaller and smaller portions at the outlet slots 42 at the second end, to avoid flowstream interactions thereby to further reduce the noise. The preferred embodiment of the present disclosure is demonstrated using a plate stack 39 containing four similar plates 38 specifically oriented to create a sparger unit 22, along with top and bottom solid plates 47*a*, 47*b*. The solid top plate 47*a* and a solid bottom plate 47*b* (see FIG. 5, with portions of solid plate 47*a* broken away for better viewing) are provided to assure for each sparger pane unit 22 that the fluid flow is correctly diverted through the sparger 22 and to help provide mounting of the flat plates 38 of the sparger 22 to the frame 24 and then to the condenser duct 30. The total number of plates 38 used in each sparger unit 22, comprising the overall sparger grid assembly 20, is dependent upon the process application requirements (e.g. the desired pressure drop and/or the size of the duct) and the properties of the fluid flow in the application. Preferably, such mounting is along the outer wall surface 32 of the duct 30.

As seen in FIGS. 1 and 1A, each window pane sparger unit 22 is mounted to a support frame 24, which collectively makes up the "window pane" arrangement, in effect, as mounted to the wall 32 of the condenser duct 30. Thus, the mounting frame 24 acts to support each individual sparger unit 22, within the overall sparger assembly 20, along the duct wall 30. As understood, it does not matter whether the respective flat plates 38 are in a parallel or an axial alignment relative to the central longitudinal axis CL of the condenser duct 30. That is, it is believed the plates 38 will work well in either orientation.

Figure 6:
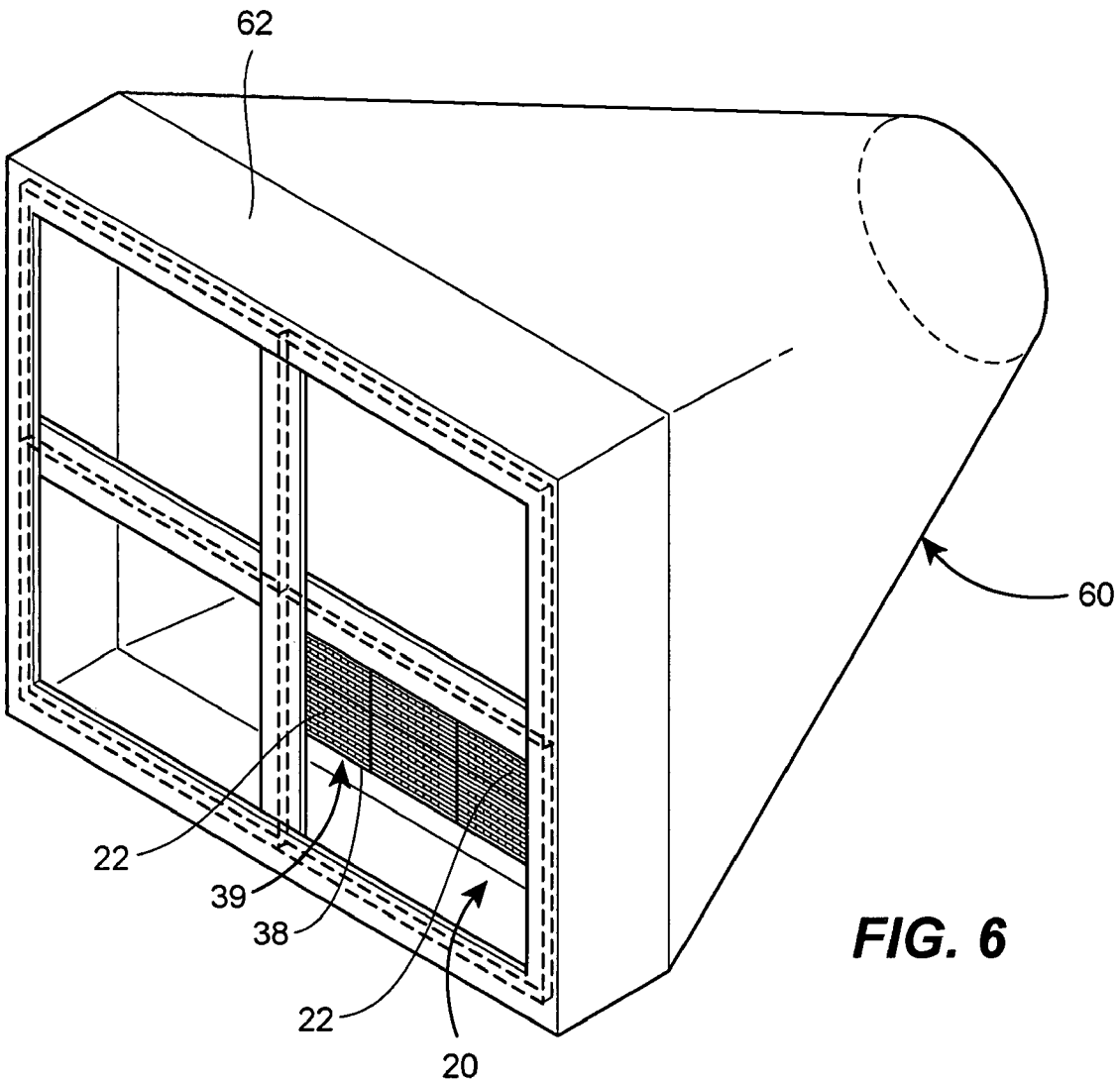
FIG. 6 is a perspective view of an alternate use of the assembled grid of sparger units of FIG. 1.

An alternate embodiment and another aspect of the present disclosure is shown in FIG. 6, which depicts the window pane sparger grid assembly 20 as mounted to an elongated plenum 60 of a straight side duct type condenser piping system for an air cooled condenser system in a power generating plant. It is these type plenums that are capable of withstanding large amounts of pressure, for example, in levels of approximately 100 psi, to then allow providing back pressure on the Turbine Bypass valves (not shown) in a generating plant. In this embodiment, the sparger grid assembly 20 is formed of individual window pane sparger units 22, as mounted within and supported by a framework 62, preferably formed of a suitable structural steel material. Each individual sparger unit is again formed of a stack 39 of individual flat plates 38.

Figure 7B:
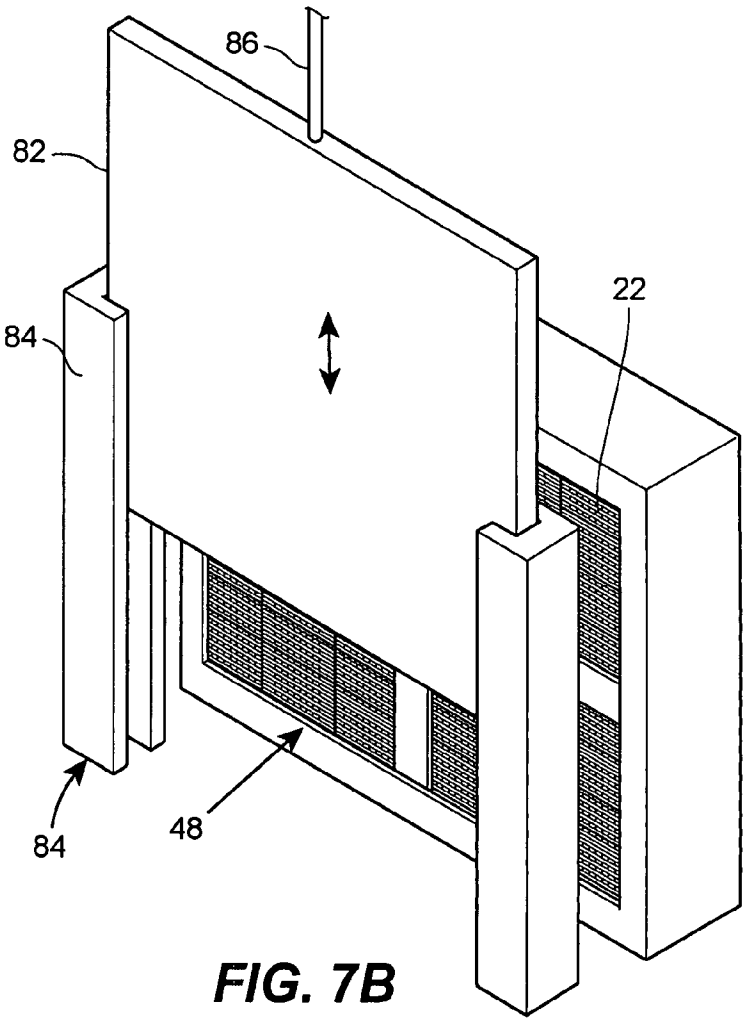
FIG. 7B is a perspective view of a linear-actuated gate flow control unit for the present window pane type sparger unit.
Figure 7A:
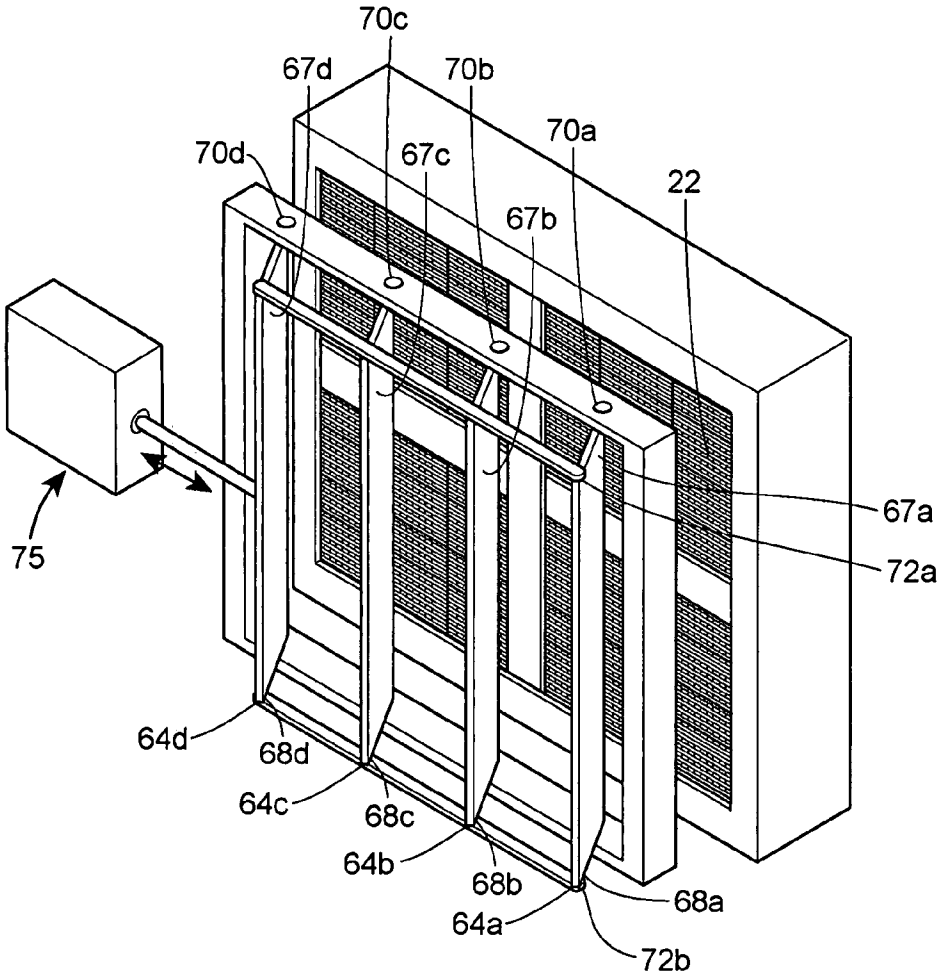
FIG. 7A is a perspective view of a variable-position vane flow control unit for the present window pane type sparger unit.

In another alternate embodiment of the present disclosure shown in FIG. 7A, there is a flow control unit 61 used to variably control the fluid flow of fluid 48 through the sparger unit 22. The flow control unit 61 is comprised of a series of variable position vanes 64*a–d* that may be formed from a plurality of flat plates positioned within a grid-like assembly forming a vane housing 66. The variable position vanes 64*a–d* are supported within the vane housing 66 by a series of longitudinal, pivotable attachments 70*a–d* affixed to a first end 67*a–d*. A translation bar 72*a–b* is pivotably attached to a second end 68*a–d* of the variable position vanes 64*a–d* substantially opposite of the first end 67*a–d*. As such, through activation of a single member, for example variable position vane 64*a*, the complete variable position vane assembly 64 can be actuated. The vanes can be controlled by an actuation system known to those skilled in the art such as a linear drive system 75. As such, the position of the vanes, with respect to transverse flow indicated by the flow arrow 48, present a variable geometry opening. That is, the effective area of the sparger can be precisely controlled. The variable geometry port facilitates control of the total inlet fluid flow area to the sparger by, for example, proportionally inhibiting or restricting fluid flow through the vanes 64*a–d*. As known, inhibiting fluid flow through a orifice or port area, a back pressure is created "upstream" from the port area such as the area defined by the variable position vanes. Specifically, this type flow control circuit can further provide a controllable backpressure to an upstream control valve (not shown) for the Turbine Bypass system. As illustrated in FIG. 7A, the variable position vanes 64 can be positioned prior to or subsequent to the sparger units 22 in the flow stream. The variable back pressure produced by use of such variable position vanes 64 can assist in minimizing noise produced by the overall system at a wide range of steam mass flow.

Similarly, a linear-actuated plate type device, illustrated in FIG. 7B and similar to a gate valve known to those skilled in the art, may also be used for varying the effective flow area of the window pane sparger units 22. The flat plate or gate 82 is guided through a frame 84 assembly moving longitudinally about an axis 86 substantially parallel to the frame 84. Numerous conventional drive systems (not shown) may be attached to the gate 82 to control or position it within the frame 84. Similar to the variable vane alternate embodiment of FIG. 7A, the adjustable gate alternate embodiment of FIG. 7B permits control of the fluid flow area of the sparger assembly. As previously discussed, such flow control units provide precise manipulation of the back-pressure within the sparger system.

As will further be appreciated, the individual window pane sparger units 22, i.e. brick-type shaped spargers, can be assembled into standard sizes, such as 50 inches by 150 inches for example, when used with a condenser duct 30 having an overall diameter of 336 inches, for example. Alternatively, each sparger unit 22 can instead be formed of customized sizes, so to create the needed overall "window pane" sparger assembly 20 for a given end-use application. The size and/or the number of individual window pane sparger units used in a given mounting frame can be decreased or increased to handle smaller or larger mass flow requirements, lower pressure drop requirements, and other variations in end-use requirements.

As seen, a significant advantage of the sparger apparatus of the presenting disclosure is that, unlike prior art sparger designs, the present sparger minimizes restriction to steam flow in the condenser duct 30 going past the sparger, as the sparger unit 22 does not extend any substantial depth into the condenser duct. Further, because the outlets of the respective sparger units 22 all extend in transverse (or alternatively, in a parallel axially-aligned) fashion into the steam flow within the condenser duct 30, there is no substantial recombination of the outlet fluid flow jet. Thus, any increased noise or vibration problems due to such sparger outlet jet combination, as found with prior art sparger units, is substantially eliminated with the apparatus of the present disclosure.

Additionally, a method for creating a noise- and vibration-reducing flexible-size sparger, comprises the following steps: First, a support frame is mounted to an opening in the wall of the duct involved, such as a condenser-duct. Second, various respective stacked flat plate arrangements are formed up to include respective flat plates having a series of inlet openings at a first end and a series of outlet openings at the opposite second end. The plurality of the stacked flat plate arrangements are then mounted within the support frame on the duct wall to create a pattern of such arrangements. When so mounting the plurality of stacked flat plate arrangements, they are caused to extend to a greater length exteriorly than interiorly of the duct.

Additional method steps for creating a noise- and vibration-reducing flexible-size sparger can include the following: The flat plates making up each stacked flat plate arrangement can be formed to include both flow plates and plenum plates in an alternating arrangement. Separately, the ratio of the number of outlet openings to the number of inlet openings can be caused to be at least 2:1. Separately, the mounting frame can be formed so as to be able to mount to either a flat duct wall or to a curved duct wall, or otherwise, that frame can be formed as required to properly fit the shape of the duct wall.

The foregoing detailed description has been given for clearness of understanding only, and no unnecessary limitation should be understood therefrom, as modifications will be obvious to those skilled in the art.

I claim:

1. A sparger assembly for use with a duct comprising:

a plurality of individual sparger units, each sparger unit having a stacked plate arrangement, each arrangement of stacked plates having a series of flat plates; and a mounting frame capable of supporting the plurality of individual sparger units in a grid like assembly, the mounting frame adapted to be mounted to the wall of a duct.

2. The invention of claim 1, wherein the flat plates comprise flow plates and plenum plates.

3. The invention of claim 2, wherein each flow plate has respective inlet slots and outlet slots, and each plenum plate has intervening plenums.

4. The invention of claim 2, and with the stack of flat plates positioned between a solid top plate and a solid bottom plate.

5. The invention of claim 1, wherein the plurality of individual sparger units are mounted in a side-by-side array within the mounting frame.

6. The invention of claim 1, wherein the flat plates have on one side a plurality of inlet slots, on the opposite side a plurality of outlet slots, and series of passageways between the respective inlet slots and outlet slots to permit fluid flow therebetween.

7. The invention of claim 6, where the ratio of the plurality of outlet slots to the plurality of inlet slots is at least approximately 4:1.

8. The invention of claim 1, wherein the series of flat plates for each stacked plate arrangement are aligned one of generally transverse to and generally parallel to the longitudinal axis of the associated duct.

9. The invention of claim 1, wherein the mounting frame is adapted to mount to one of a flat-walled condenser duct and to a curved wall duct.

10. The invention of claim 1, wherein the flat plates extend inwardly into the duct and outwardly of the duct relative the mounting frames, and the depth of the outward extension is greater than the depth of the inward extension, thereby to reduce fluid flow restriction within the condenser duct due to the pressure of the sparger assembly.

11. The invention of claim 1, wherein a variable flow control unit is positioned within a duct upstream from the sparger assembly, the variable flow control unit being substantially adjacent to the inlets of the individual spargers and being operable to control the effective area of fluid flow impinging the sparger assembly, thereby producing a variable back pressure in the duct to assist in minimizing noise and vibration created by the sparger assembly.

12. The invention of claim 11, wherein the variable flow control unit comprises at least one variable position vane.

13. The invention of claim 11, wherein the variable flow control unit comprises a linear-actuated plate.

14. The invention of claim 1, wherein the flat plates each comprise both flow regions and plenum regions.

15. A fluid pressure reduction device comprising:

a plurality of individual fluid pressure reduction units, each fluid pressure reduction unit having a stacked flat plate arrangement, each plate containing a plurality of fluid passageways in fluid communication with a plurality of inlets disposed upon a first end of the fluid pressure reduction device and a plurality of outlets disposed upon a second end of the fluid pressure reduction device, the second end being substantially opposite of the first end wherein the passageways substantially reduce the fluid pressure between the plurality of inlets and outlets; and a mounting frame capable of supporting the plurality of individual fluid pressure reduction units in a grid like assembly.

16. The fluid pressure reduction device of claim 15, wherein the plurality of stacked plates includes alternating first and second plates, the first plate containing a fluid inlet stage containing slots partially extending from the first end towards the second end and a fluid outlet stage containing slots partially extending from the second end towards the first end; and, the second plate having at least one plenum region extending through the plate wherein the plates are selectively positioned in the stack to direct fluid flow only through the fluid inlet stage slots of the first plate aligned to the plenum slots in adjacent second plates and to the fluid outlet stage slots in at least one first plate, wherein the fluid flow path is split into two initial axial directions, then into the plenum slots with multiple radial flow directions, and then distributed through multiple outlet stage slots in at least one first plate.

17. The invention of claim 16, where the ratio of the plurality of outlet slots to the plurality of inlet slots is at least approximately 2:1.

18. The invention of claim 15, and with the stack of flat plates positioned between a solid top plate and a solid bottom plate.

19. The invention of claim 15, wherein the plurality of individual sparger units are mounted in a side-by-side array within the mounting frame.

20. A method for substantially reducing the restriction of a fluid flow through a duct, and the unwanted noise and vibration attendant thereto, comprising the steps of mounting a support frame to an opening in the wall of the duct;

forming respective stacked flat plate arrangements to include respective flat plates having a series of inlet openings at a first end and a series of outlet openings at the opposite second end;

mounting a plurality of the stacked flat plate arrangements within the support frame; and causing the plurality of stacked flat plate arrangements to extend to a greater length exteriorly than interiorly of the duct.

21. The method of claim 20, and the step of forming the flat plates making up each stacked flat plate arrangement to include both flow plates and plenum plates.

22. The method of claim 20, and, in the step of forming respective stacked plate arrangements, the further step of causing the ratio of the number of outlet openings to the number of inlet openings to be at least 2:1.

23. The method of claim 20, and, in the step of mounting a support frame to the wall of the duct, the step of forming the mounting frame to be able to mount to one of a flat duct wall and a curved duct wall, as required to fit the duct.

24. The method of claim 20, and the step of forming the flat plate making up each stacked flat plate arrangement to include forming each plate to include both a plenum region and a flow region.

* * * * *

UNITED STATES PATENT AND TRADEMARK OFFICE

CERTIFICATE OF CORRECTION

PATENT NO. : 7,044,437 B1
APPLICATION NO. : 10/988111
DATED : May 16, 2006
INVENTOR(S) : Robert T. Martin It is certified that error appears in the above-identified patent and that said Letters Patent is hereby corrected as shown below:

On the Title Page: Assignee

At line (73), "LLC." should be -- LLC --.

At Column 7, line 34, "condenser-duct" should be -- condenser duct --.

Signed and Sealed this

Eighth Day of May, 2007

JON W. DUDAS
*Director of the United States Patent and Trademark Office*